US005821955A

United States Patent [19]

Waschhauser

[11] Patent Number: 5,821,955

[45] Date of Patent: Oct. 13, 1998

[54] BLOTTER FOR INK ABSORPTION

[75] Inventor: Heinz Waschhauser, Escondido, Calif.

[73] Assignee: Hewlett-Packard Company, Palo Alto, Calif.

[21] Appl. No.: 742,962

[22] Filed: Nov. 1, 1996

Related U.S. Application Data

[63] Continuation of Ser. No. 507,795, Jul. 26, 1995, abandoned, which is a continuation of Ser. No. 55,044, Apr. 28, 1993, abandoned.

[51] Int. Cl.[6] ..... B41J 2/165

[52] U.S. Cl. ..... 347/36

[58] Field of Search ..... 347/29, 31, 32, 347/36, 43, 86

[56] References Cited

U.S. PATENT DOCUMENTS

| | | | |
|---|---|---|---|
| 3,441,950 | 4/1969 | Miller | 346/140.1 |
| 4,017,871 | 4/1977 | Hubbard | 346/140.1 |
| 4,872,026 | 10/1989 | Rasmussen et al. | 347/56 |
| 5,018,884 | 5/1991 | Hirano et al. | 347/43 |
| 5,023,629 | 6/1991 | Kiyohara | 347/36 |
| 5,221,935 | 6/1993 | Uzita | 347/86 |
| 5,317,339 | 5/1994 | Braun et al. | 347/87 |
| 5,430,471 | 7/1995 | Nakajima et al. | 347/87 |

FOREIGN PATENT DOCUMENTS

| | | | |
|---|---|---|---|
| 262656 | 12/1985 | Japan | 347/36 |
| 275050 | 11/1989 | Japan | 347/36 |
| 90361 | 3/1992 | Japan | 347/31 |
| 286655 | 10/1992 | Japan | 347/22 |

*Primary Examiner*—David F. Yockey

[57] ABSTRACT

A blotter for ink absorption in ink-jet printers includes two parts of a cellulose fiber material, one adjacent the other and in physical contact, beneath the service station and on the base of the printer. The blotter parts have the capacity to simultaneously absorb at least the contents of four ink cartridges, and will last the lifetime of the printer. As a consequence of the blotter of the present invention, ink from leaky ink cartridges and ink overflow from ink cartridge maintenance are absorbed and contained. Over time, the water in the inks which has been absorbed by the blotter parts will evaporate and an additional volume of ink can be absorbed.

6 Claims, 3 Drawing Sheets

BLOTTER FOR INK ABSORPTION

CROSS REFERENCE TO RELATED APPLICATION(S)

This is a continuation of application Ser. No. 08/507,795 filed on Jul. 26, 1995 now abandoned, which is a continuation of application Ser. No. 08/055,044 filed Apr. 28, 1993 now abandoned.

TECHNICAL FIELD

The present invention related to ink-jet printers, and, more particularly, to ink-jet printers including means for preventing ink contamination of electronic and mechanical parts.

BACKGROUND ART

Ink-jet printers of the type disclosed and claimed in U.S. Pat. No. 4,872,026, issued Oct. 3, 1989, and assigned to the same assignee as the present application commonly include a service station for storing the pen(s) during non-use and for performing other operations, such as priming or clearing the nozzles of the pen, sealing the printhead during non-printing operations, and cleaning the printhead.

Dealing with any ink removed from the pen by priming can be messy. The solution posed in the above-mentioned U.S. Pat. No. 4,872,026 utilized both a spittoon and a cap chamber. All nozzles in the printhead are cleared periodically by firing into the spittoon during printing, and all nozzles are fired into the cap chamber each time the cap is engaged to cover the printhead portion of the pen during non-printing operations. Firing into the cap chamber provides a reservoir of ink which acts as a moisture source to keep the printhead from drying up during printing. Attached to the bottom of the cap chamber is a peristaltic pump, which comprises a plastic tube, a roller, and a pump body. One end of the tube is attached to the bottom of the cap chamber, while the other end terminates in free space, over an absorber pad. The absorber pad is used as a holding vessel while any ink that reaches the absorber pad evaporates into the air. The peristaltic pump serves to prime the pen.

While the afore-mentioned U.S. Pat. No. 4,872,026 is useful for its intended purpose, that patent is directed to a single pen, namely, for printing black ink. More recent advances in the art of ink-jet printing have developed color printers, employing four pens, one each containing cyan, magenta, yellow, and black ink.

The operations associated with priming four pens generates considerably more ink to be disposed of than could be handled by the original one-pen printer. Further, catastrophic failure of one or more pens can result in a substantial quantity of ink being released into the interior of the printer, causing possible contamination of the electronics and mechanical operation of the printer.

Accordingly, means capable of absorbing large quantities of ink in multi-pen printers is required.

DISCLOSURE OF INVENTION

In accordance with the invention, a blotter assembly for ink absorption in ink-jet printers is provided. The blotter assembly comprises:

(a) an absorbing medium having a size and capacity to absorb up to about 140 $cm^3$ of ink; and (b) means for maintaining the blotter assembly beneath the service station and on a portion of the chassis beneath the service station so as to absorb any ink leaking from any of the cartridges or any ink resulting from cartridge maintenance to the blotter assembly.

In particular, the blotter assembly comprises two parts of a cellulose fiber material, one adjacent the other and in physical contact therewith, beneath the, service station and on the base of the printer. The blotter parts have the capacity to absorb at least the contents of four ink cartridges, and will last the lifetime of the printer.

The blotter assembly of the present invention absorbs and contains ink from leaky ink cartridges and ink overflow from ink cartridge maintenance to prevent contamination of the printer electronics and surrounding environment.

BEST MODES FOR CARRYING OUT THE INVENTION

Figure 1:
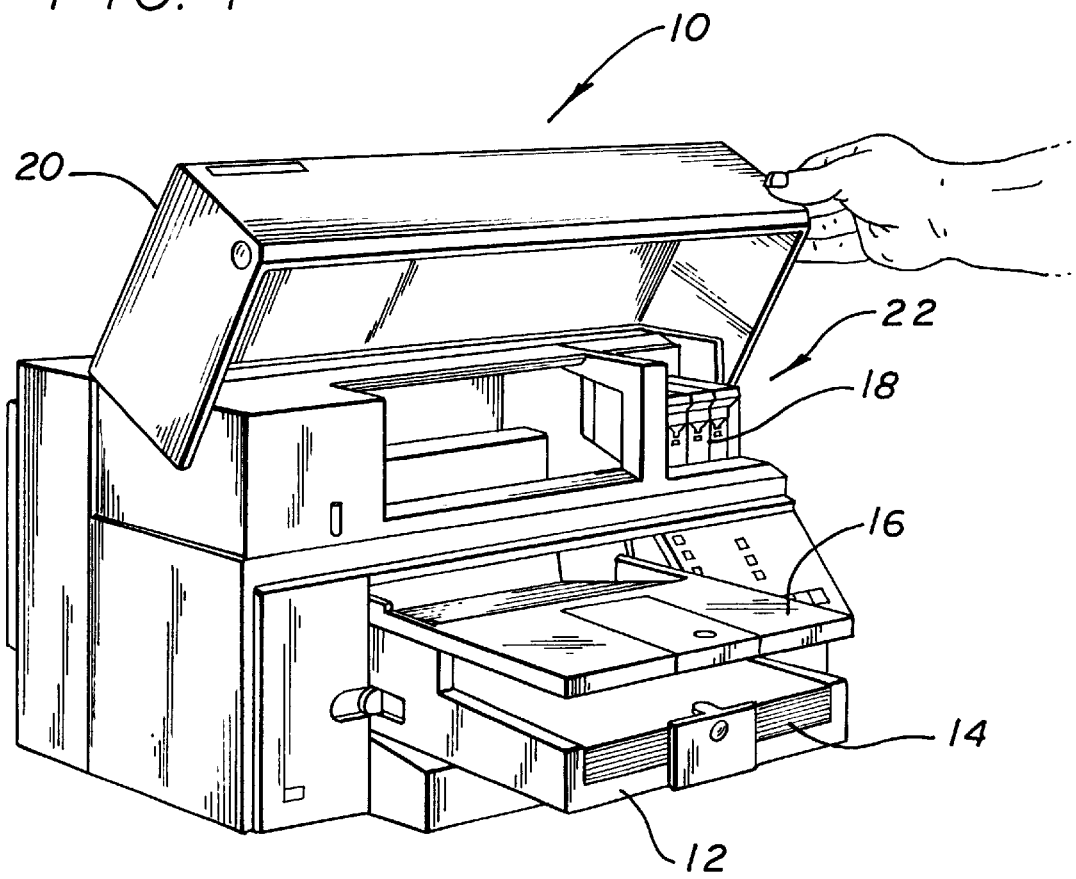
FIG. 1 is a perspective view of an ink-jet printer which employs the blotter assembly of the invention.

Referring now to FIG. 1, a printer 10 is shown, comprising a paper feed tray 12 for storing a supply of paper or other print medium 14 to be printed, a paper collection tray 16 for collecting the printed paper, and a plurality of print cartridges 18. In the printer depicted in FIG. 1, four such cartridges are provided: cyan, magenta, yellow, and black. Together, these four colors provide a wide palette of colors, tints, and hues. The printer 10 is depicted with its cover 20 raised to expose the service station 22 and the four cartridges 18 stored therein. Other features of the printer 10, such as the platen, paper feed mechanism, printer electronics, etc. are not depicted, as they are not critical to the blotter assembly of the invention. Such other features are well-known in the art of ink-jet printing. The above-referenced U.S. Pat. No. 4,872,026 is merely exemplary of such ink-jet printers.

Figure 2:
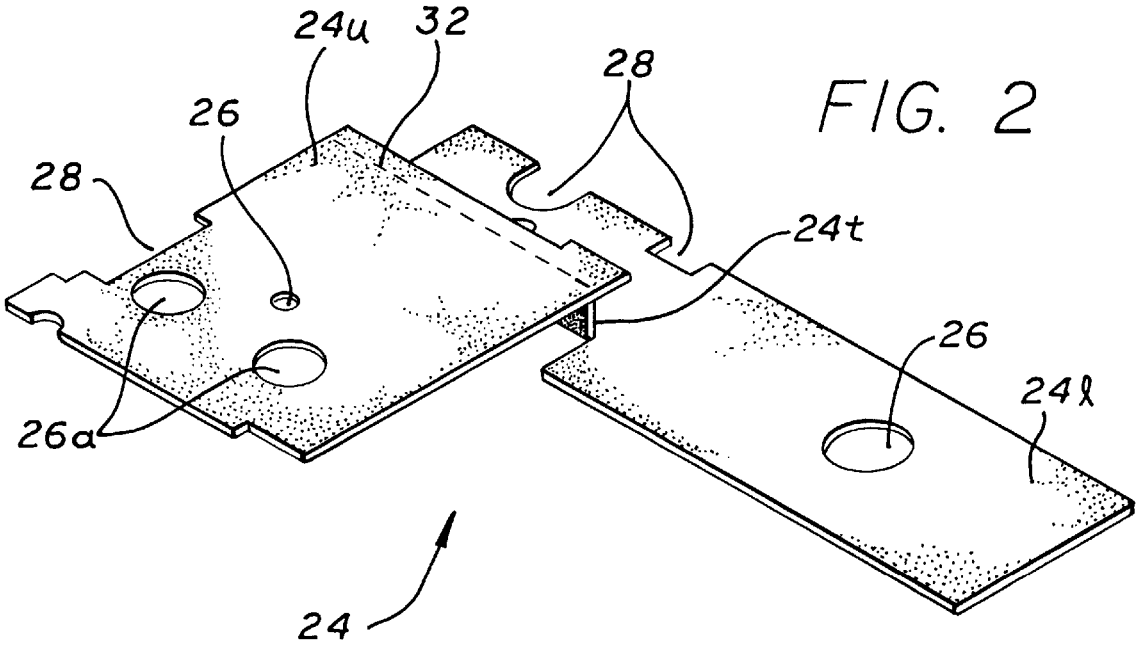
FIG. 2 is a perspective view of the blotter assembly of the invention.

In accordance with the invention, a blotter assembly 24 is provided. As shown in FIG. 2, the blotter assembly 24 comprises two portions, an upper portion 24*u* and a lower portion 24*l*. The two portions are mechanically interconnected by a tab portion 24*t*, the edge of which touches the bottom of upper portion 24*u*, along line 32.

Figure 3A:
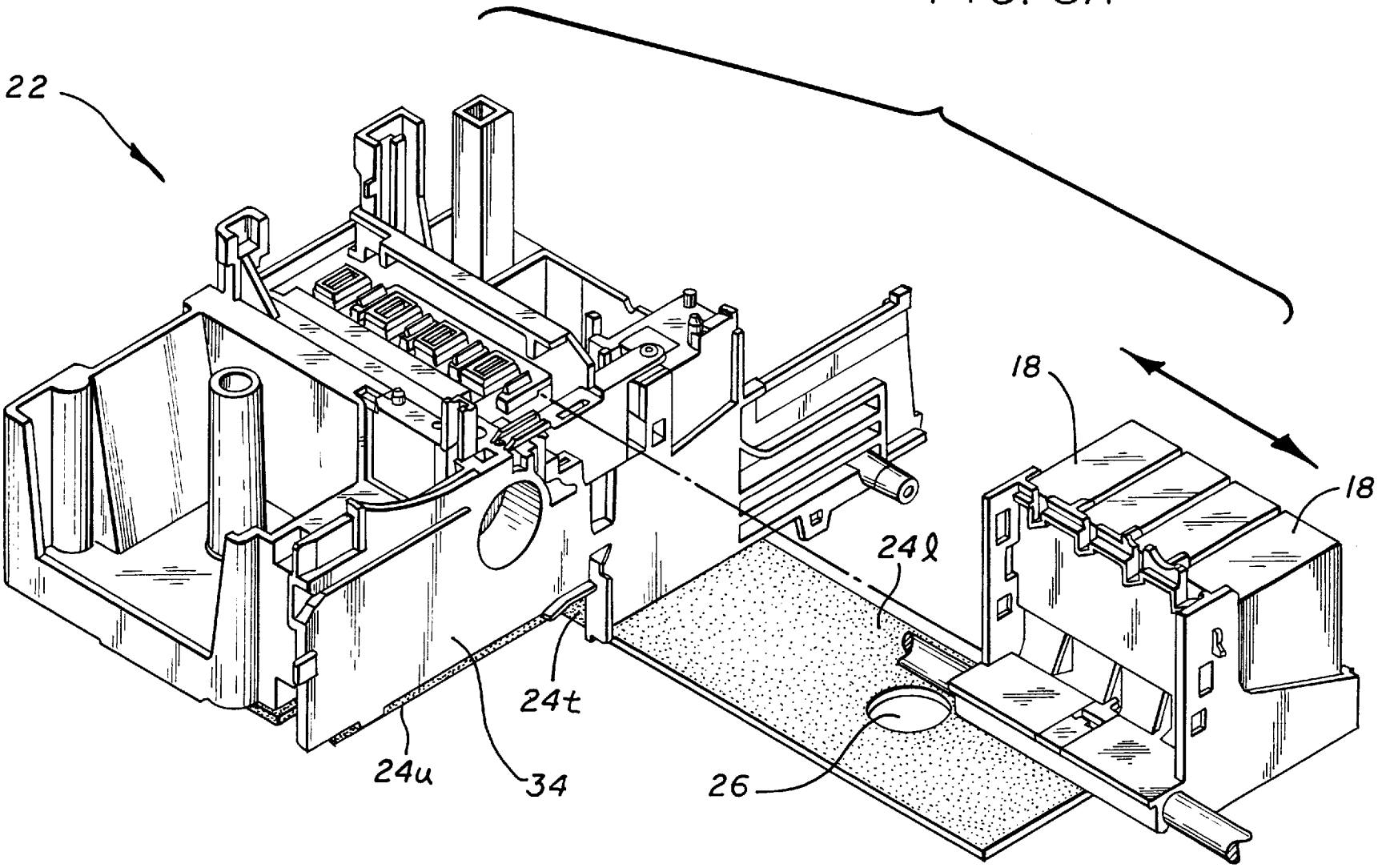
FIG. 3A is a perspective view of a portion of the ink-jet printer shown in FIG. 1, depicting the relationship of the blotter assembly of the invention with respect to the printer's service station for storing and maintaining a plurality of ink pens.
Figure 3B:
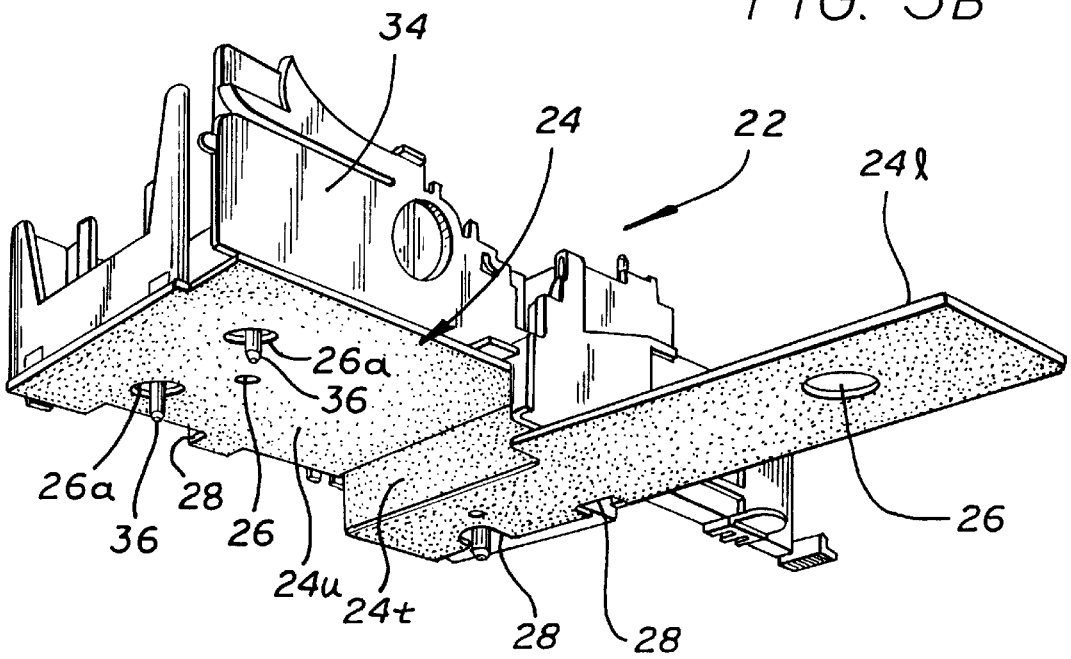
FIG. 3B is another perspective view of the portion of the ink-jet printer shown in FIG. 3A.

FIGS. 3A and 3B show the blotter assembly 24 of the invention relative to the service station 22. The blotter assembly 24 parts are sandwiched between the machine base (a sheet metal box, not shown, containing the electronics of the printer) and the right hand chassis part (the service station 22) and the paper feed mechanism (not shown).

The upper portion 24*u* of the blotter assembly 24 is placed directly below the service station 22 and the stored print cartridges 18. Any ink leaking from the cartridges 18 or ejected from them during servicing is captured by this blotter portion 24*u* and absorbed. Since the absorbing capacity of this blotter portion 24*u* is limited, any overflow in a worst-case situation (e.g., catastrophic failure of all four print cartridges) is directed to the lower part 24*l* through the contact area, shown in FIG. 2, by means of the tab portion 24*t*.

The shape of the blotter portions is not overly critical, and may include cutouts 26, 26*a* and indentations 28 to accommodate other features of the printer chassis in which it is situated. However, of greater importance is the capacity of the blotter assembly 24. The combined absorbing capacity of the blotter assembly 24 is on the order of 140 $cm^3$. The upper portion 24*u* has a volume of about 50 $cm^3$ and an absorbing capacity of about 60 $cm^3$, while the lower portion 24*l* has a volume of about 65 $cm^3$ and an absorbing capacity of about 80 $cm^3$. The upper portion 24*u* and lower portion 24*l* of the blotter assembly may be aptly termed a low absorption member and a high absorption member, respectively, given that the lower portion 24*l* has the higher absorption capacity of the two portions. The thickness of each portion is about 2.5 mm. The blotter material comprises cellulose fibrous material, such as filter paper.

The absorbing capacity of about 140 $cm^3$ is sufficient to simultaneously absorb the contents of four print cartridges. Each print cartridge has a maximum fluid capacity of 42 $cm^3$, although only about 35 $cm^3$ of fluid is available, due to the use of a spring bag reservoir inside the pen, which retains about 7 $cm^3$ of the ink. Further, it will be appreciated that over time, the water in the inks which has been absorbed by the blotter parts will evaporate and an additional volume of ink can then be absorbed.

Figure 4:
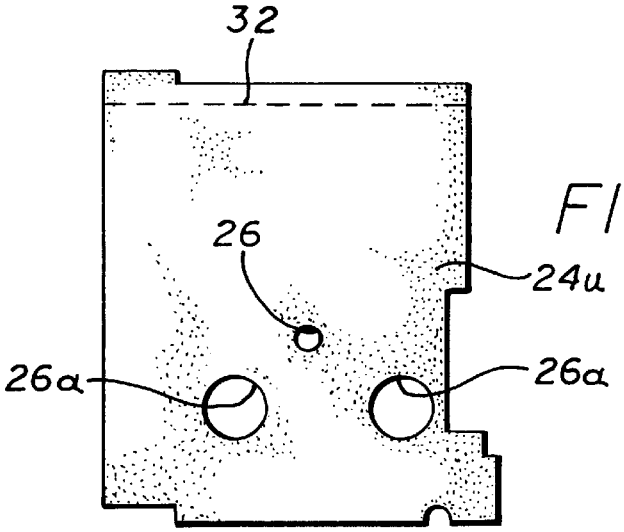
FIG. 4 is a top plan view of one portion of the blotter assembly of the invention.
Figure 5:
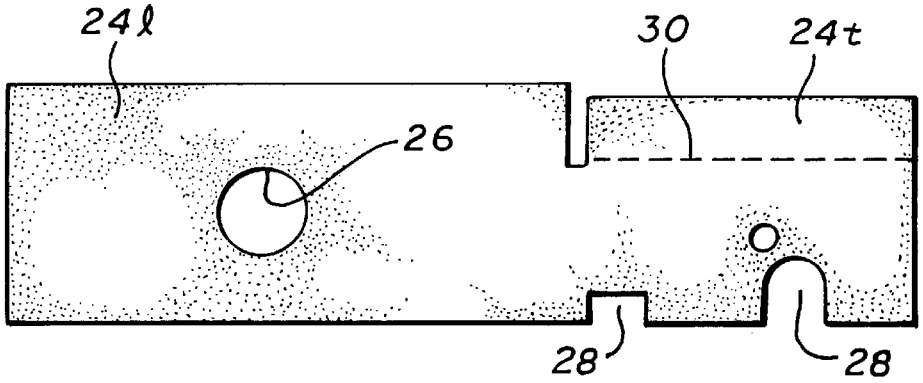
FIG. 5 is a top plan view of a second portion of the blotter assembly of the invention.

FIG. 4 depicts a top plan view of the upper portion 24*u* of the blotter assembly 24, while FIG. 5 depicts a top plan view of the lower portion 24*l* of the blotter assembly. The tab portion 24*t* is formed by bending a part of the lower portion 24*l* along the dotted line 30.

The parts are assembled by placing the lower portion 24*l* on the inside surface of the bottom of the printer chassis, with the tab portion 24*t* perpendicular to the plane of the lower portion. The tab portion 24*t* of the blotter assembly may be termed a residual absorption member given its containment of any ink not absorbed by the upper portion 24*u* or the lower portion 24*l*. The upper portion 24*u* is then placed in position such that a part thereof, denoted 32, is in physical contact with the top surface of the tab portion 24*t*. A flat plastic piece 34 is then placed on top of the blotter assembly 24 to ensure maintaining physical contact of the upper portion 24u with the tab portion 24*t*. The plastic piece 34 is aligned by two pins 36 (shown in FIG. 3B) through holes 26*a* and held in place by metal straps (not shown).

INDUSTRIAL APPLICABILITY

The blotter assembly of the present invention is expected to find use in ink-jet printers for absorbing ink from potentially leaky cartridges and from ink overflow from ink cartridge maintenance.

Thus, there has been disclosed a blotter assembly for ink absorption in ink-jet printers. It will be readily apparent to those skilled in this art that various changes and modifications of an obvious nature may be made, and all such changes and modifications are considered to fall within the scope of the invention, as defined by the appended claims.

What is claimed is:

1. A printer system including:

(a) a plurality of ink cartridges;

(b) a service station for storing and servicing said plurality of ink cartridges;

(c) a chassis for supporting said service station and other components of said printer; and (d) a blotter assembly to prevent contamination of electronic components of said printer system from ink leaking from said plurality of ink cartridges and ink overflowing during maintenance of said plurality of ink cartridges, said blotter assembly comprising:

(i) an absorbing medium comprising an upper portion, a lower portion, and a tab portion, said upper portion and said lower portion being maintained in physical contact by said tab portion, said absorbing medium having a size and capacity to absorb about 140 $cm^3$ of ink; and (ii) means for maintaining said absorbing medium beneath said service station, said upper portion of said absorbing medium being maintained directly beneath said service station so as to absorb, during said servicing, all ink leaking from any of said cartridges and all ink ejected from said plurality of ink cartridges.

2. A printer system including:

(a) a plurality of ink cartridges;

(b) a service station for storing and servicing said plurality of ink cartridges;

(c) a chassis for supporting said service station and other components of said printer; and (d) a blotter assembly to prevent contamination of electronic components of said printer system from ink leaking from said plurality of ink cartridges and ink over-flowing during maintenance of said plurality of ink cartridges, said blotter assembly comprising:

(i) an absorbing medium having a size and capacity to absorb about 140 $cm^3$ of ink; and (ii) means for maintaining at least a portion of said absorbing medium directly beneath said service station so as to absorb, during said servicing, all ink leaking from any of said cartridges and all ink ejected from said plurality of ink cartridges, wherein said blotter assembly comprises an upper portion, a lower portion, and a tab portion, said upper portion and said tab portion being maintained in physical contact by said tab portion.

3. The blotter assembly of claim 2 further comprising a plastic piece part, wherein said plastic piece part rests on said upper portion, providing pressure to maintain said physical contact.

4. The printer system of claim 2 wherein said upper portion has an absorbing capacity of at least 60 $cm^3$ and wherein said lower portion has an absorbing capacity of at least 80 $cm^3$.

5. The printer system of claim 2 wherein said absorbing medium comprises a cellulose fibrous material.

6. In a inkjet printer including at least four ink cartridges, each of said cartridges having an available predetermined fluid volume so that all four ink cartridges together have a total available predetermined fluid volume, a blotter assembly, comprising:

(a) a low absorption member having a low absorption capacity of about 60 $cm^3$, said low absorption capacity being sufficient to absorb the available predetermined fluid volume of at least an individual one of the plurality of ink cartridges, but not a sufficient capacity to absorb said total available predetermined fluid volume of all the ink cartridges;

(b) a high absorption member having a high absorption capacity of about 80 $cm^3$ of ink, said high absorption capacity being sufficient to absorb the available predetermined fluid volume of at least another individual one of the plurality of ink cartridges, but not a sufficient capacity to absorb said total available predetermined fluid volume of all the ink cartridges; and (c) a residual absorption member having a measurable absorption capacity, wherein said high absorption member and said residual absorption member are disposed perpendicular to one another and are connected integrally together and wherein said residual absorption member is in physical contact with said low absorption member to facilitate fluid transfer therebetween, said measurable absorption capacity being a sufficient capacity to absorb any of said total available predetermined fluid volume of the ink cartridges not capable of being absorbed by said low absorption member and said high absorption member, so that in combination, said low absorption member, said residual absorption member and said high absorption member have a sufficient capacity to absorb the total available predetermined fluid volume of all the ink cartridges to prevent ink contamination of the inkjet printer, wherein said low absorption member is disposed above said high absorption member to facilitate the downward flow of fluid from said low absorption member to said high absorption member through said residual member.

* * * * *

UNITED STATES PATENT AND TRADEMARK OFFICE

CERTIFICATE OF CORRECTION

PATENT NO. : 5,821,955

DATED : October 13,1998

INVENTOR(S) : Heinz Waschhauser

It is certified that error appears in the above-identified patent and that said Letters Patent is hereby corrected as shown below:

At column 4,line 52, after "In", delete "a" and insert in lieu thereof --an--.

Signed and Sealed this

Twenty-second Day of June, 1999

*Attest:*

Q. TODD DICKINSON

*Attesting Officer*

*Acting Commissioner of Patents and Trademarks*